US011454146B2

(12) United States Patent
Ito et al.

(10) Patent No.: US 11,454,146 B2
(45) Date of Patent: Sep. 27, 2022

(54) DRAIN PLUG STRUCTURE FOR OIL PAN

(71) Applicants: Mahle International GmbH, Stuttgart (DE); Mahle Filter Systems Japan Corporation, Tokyo (JP)

(72) Inventors: Daizo Ito, Tokyo (JP); Yuichi Kato, Kanagawa (JP); Atsushi Nonaka, Tokyo (JP)

(73) Assignees: MAHLE INTERNATIONAL GMBH; MAHLE FILTER SYSTEMS JAPAN CORPORATION

( * ) Notice: Subject to any disclaimer, the term of this patent is extended or adjusted under 35 U.S.C. 154(b) by 72 days.

(21) Appl. No.: 16/768,668

(22) PCT Filed: Nov. 20, 2018

(86) PCT No.: PCT/EP2018/081876
§ 371 (c)(1),
(2) Date: May 30, 2020

(87) PCT Pub. No.: WO2019/105796
PCT Pub. Date: Jun. 6, 2019

(65) Prior Publication Data

US 2021/0172350 A1 Jun. 10, 2021

(30) Foreign Application Priority Data

Nov. 30, 2017 (JP) ..... JP2017-229900

(51) Int. Cl.
*F01M 11/04* (2006.01)

(52) U.S. Cl.
CPC . *F01M 11/0408* (2013.01); *F01M 2011/0416* (2013.01)

(58) Field of Classification Search
CPC ..... F01M 11/0408; F01M 2011/0416; B65D 41/18; B65D 41/185; B65D 41/28; B65D 41/30; B60K 2015/0432
See application file for complete search history.

(56) References Cited

U.S. PATENT DOCUMENTS 3,986,634 A * 10/1976 Smith ..... F01P 11/0214 220/288
5,638,975 A * 6/1997 Harris ..... B60K 15/0409 220/303

(Continued)

FOREIGN PATENT DOCUMENTS

CN 102472133 A 5/2012
CN 103883423 A 6/2014

(Continued)

OTHER PUBLICATIONS

Chinese Office Action dated Aug. 4, 2021 related to corresponding Chinese Patent Application No. 201880077538.9.

(Continued)

*Primary Examiner* — Minh Truong
(74) *Attorney, Agent, or Firm* — Fishman Stewart PLLC

(57) ABSTRACT

The present disclosure describes a drain plug structure for an oil pan for an internal combustion engine. The drain plug structure closes off a drain hole disposed in a bottom portion of the oil pan. The drain plug structure includes a columnar stopper portion inserted into the drain hole and rotated to prevent withdrawal. A sealing member is fitted to an outer periphery of the columnar stopper portion. An operating portion for a rotation operation is disposed on an outside exposed end portion of the columnar stopper portion. A plurality of cantilevered arcuate arm portions project radially outwards from the outside exposed end portion of the columnar stopper portion and are arranged in series along a circumferential direction. A loosening-prevention meshing (Continued)

portion is disposed on a tip end portion of each arcuate arm portion and an opening edge portion of the drain hole.

19 Claims, 16 Drawing Sheets

(56) References Cited

U.S. PATENT DOCUMENTS

| | | | | |
|---|---|---|---|---|
| 5,720,328 | A * | 2/1998 | Ott | B60K 15/04 141/312 |
| 7,344,042 | B2 * | 3/2008 | Hagano | B60K 15/0406 220/300 |
| 2003/0205578 | A1 * | 11/2003 | Newport | B60K 15/0406 220/304 |
| 2008/0135340 | A1 * | 6/2008 | Schlicker | F01M 11/0408 184/106 |
| 2011/0011865 | A1 * | 1/2011 | Cook | F01M 11/0004 220/288 |
| 2013/0068778 | A1 * | 3/2013 | Griffiths | F01M 11/0408 220/601 |
| 2018/0178643 | A1 * | 6/2018 | Enyeart | B60K 15/0406 |

FOREIGN PATENT DOCUMENTS

| | | | |
|---|---|---|---|
| DE | 102009055158 | A1 | 6/2011 |
| DE | 102010026712 | A1 | 1/2012 |
| DE | 102012211545 | A1 | 1/2014 |
| DE | 102012220695 | A1 | 5/2014 |
| DE | 102014201887 | A1 | 8/2015 |
| EP | 3208435 | A1 | 8/2017 |
| JP | 201796190 | A | 6/2017 |
| WO | 2011/008261 | | 1/2011 |

OTHER PUBLICATIONS

Chinese Search Report dated Jul. 28, 2021 related to corresponding Chinese Patent Application No. 201880077538.9.
English abstract for DE-102012220695.
English abstract for EP-3208435.
English abstract for JP-201796190.
English abstract for DE-102010026712.
English abstract for DE-10209055158.

* cited by examiner

[Fig.1]
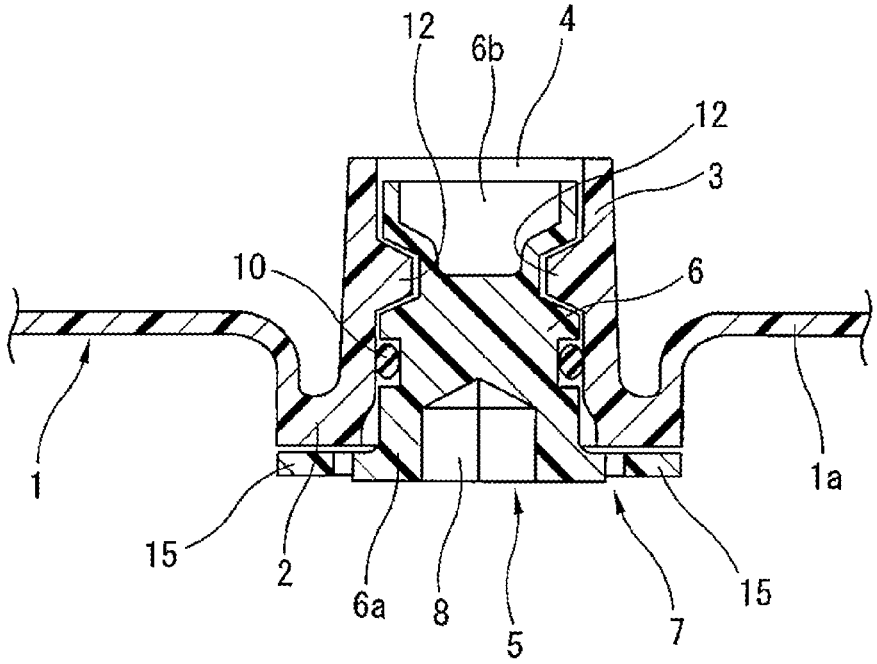

[Fig.2]
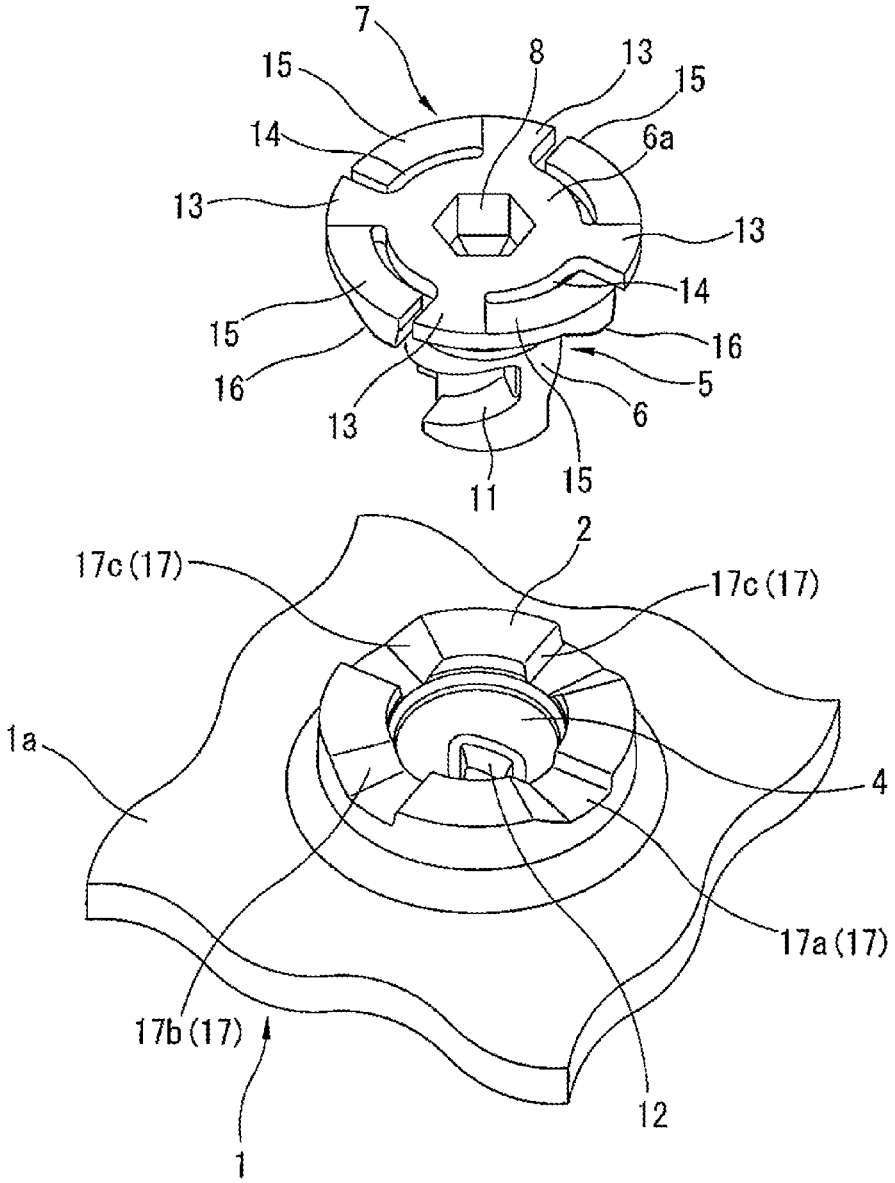

[Fig.3]
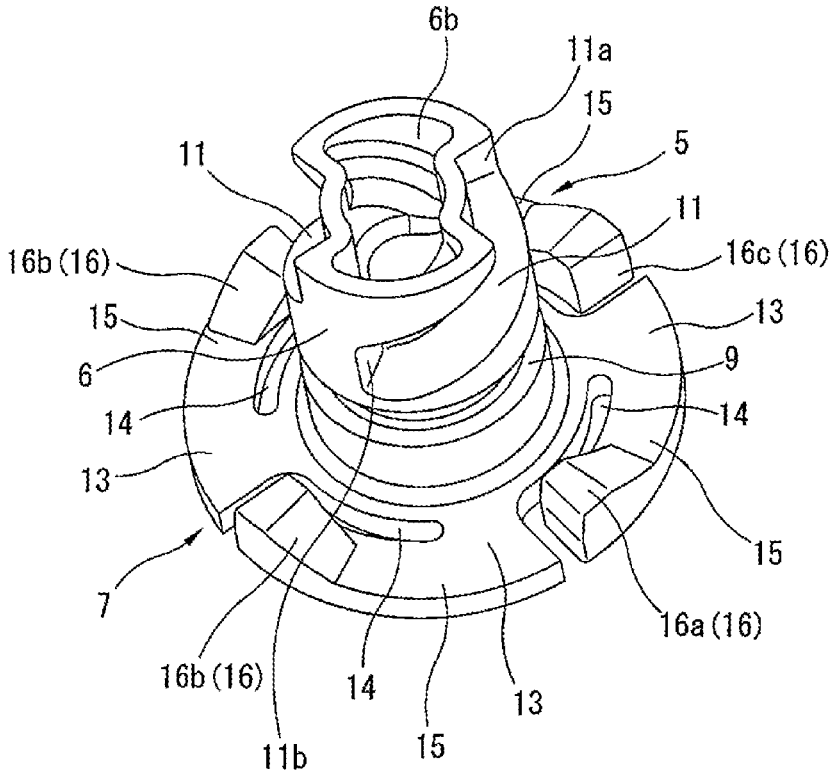

[Fig.4]
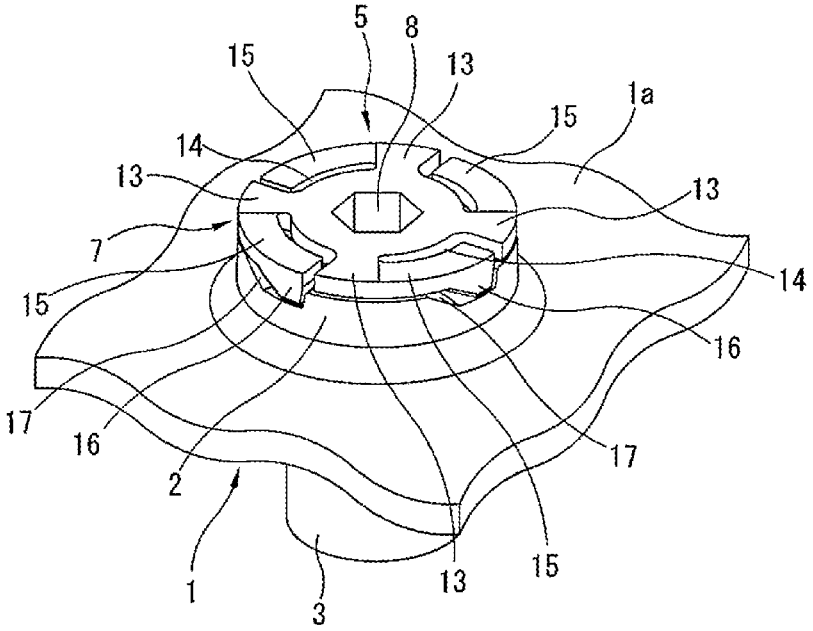
[Fig.5]
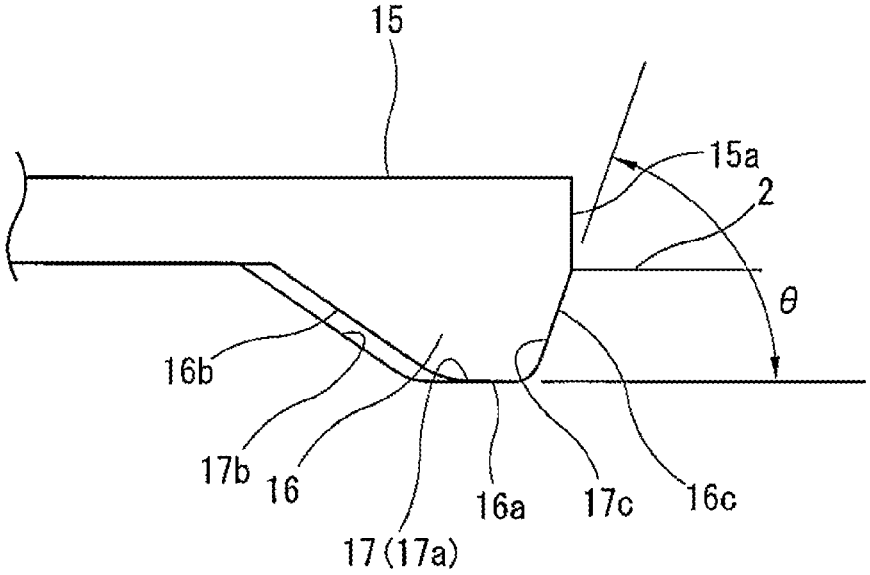

[Fig.6]
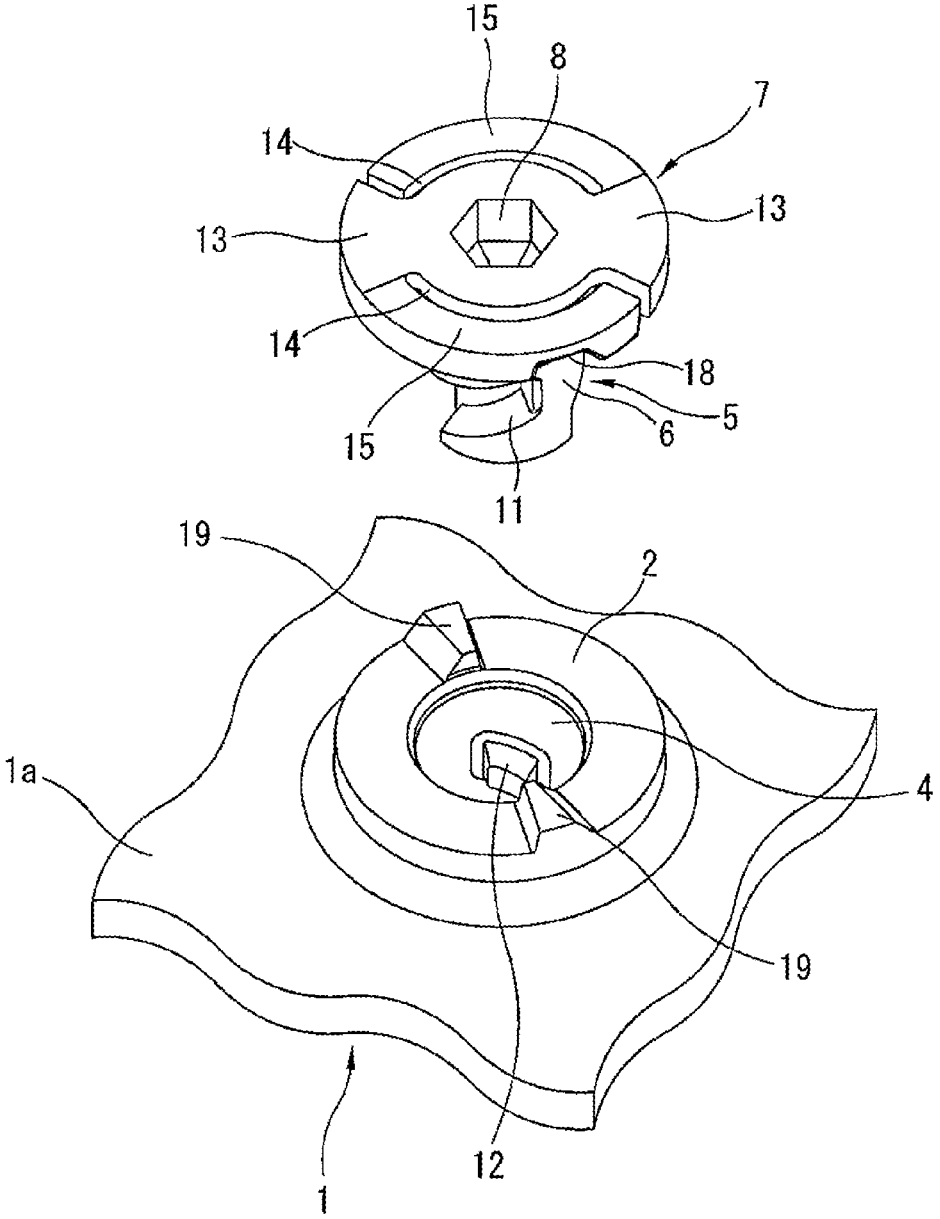

[Fig.7]
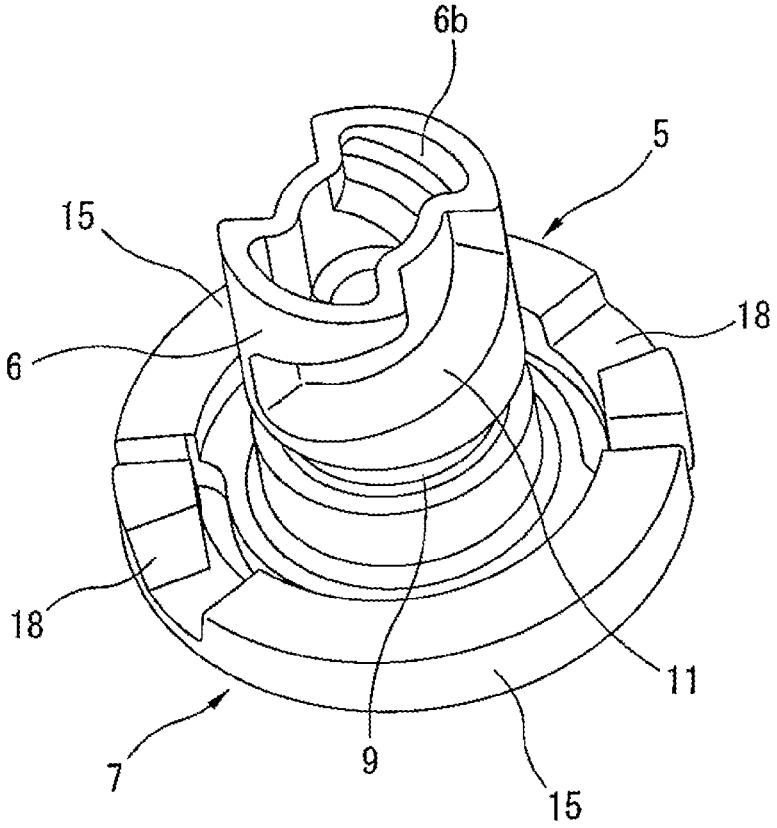

[Fig.8]
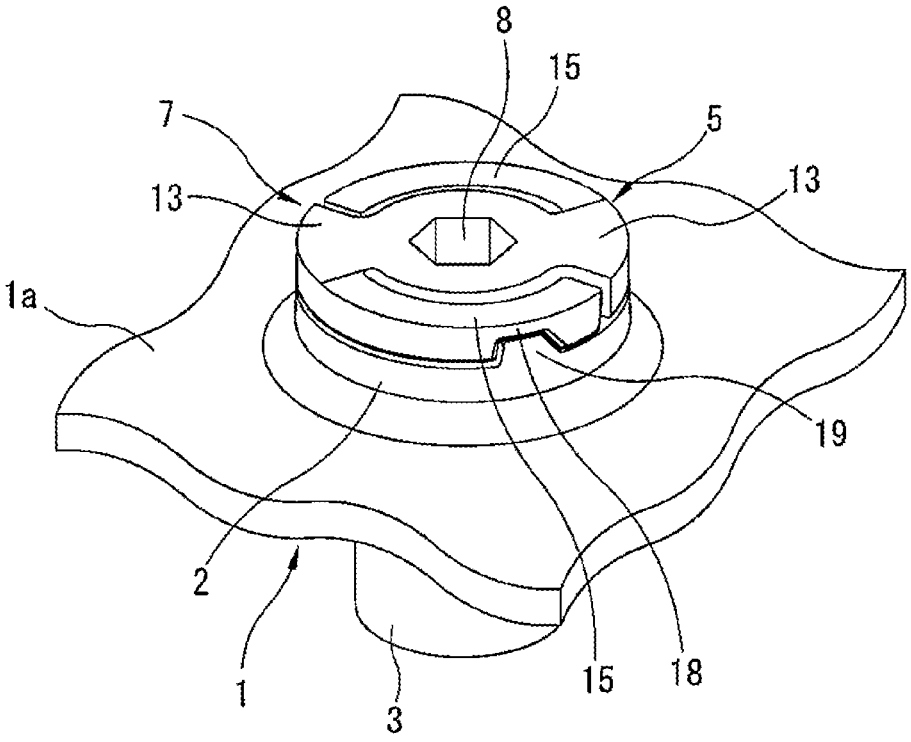

[Fig.9]
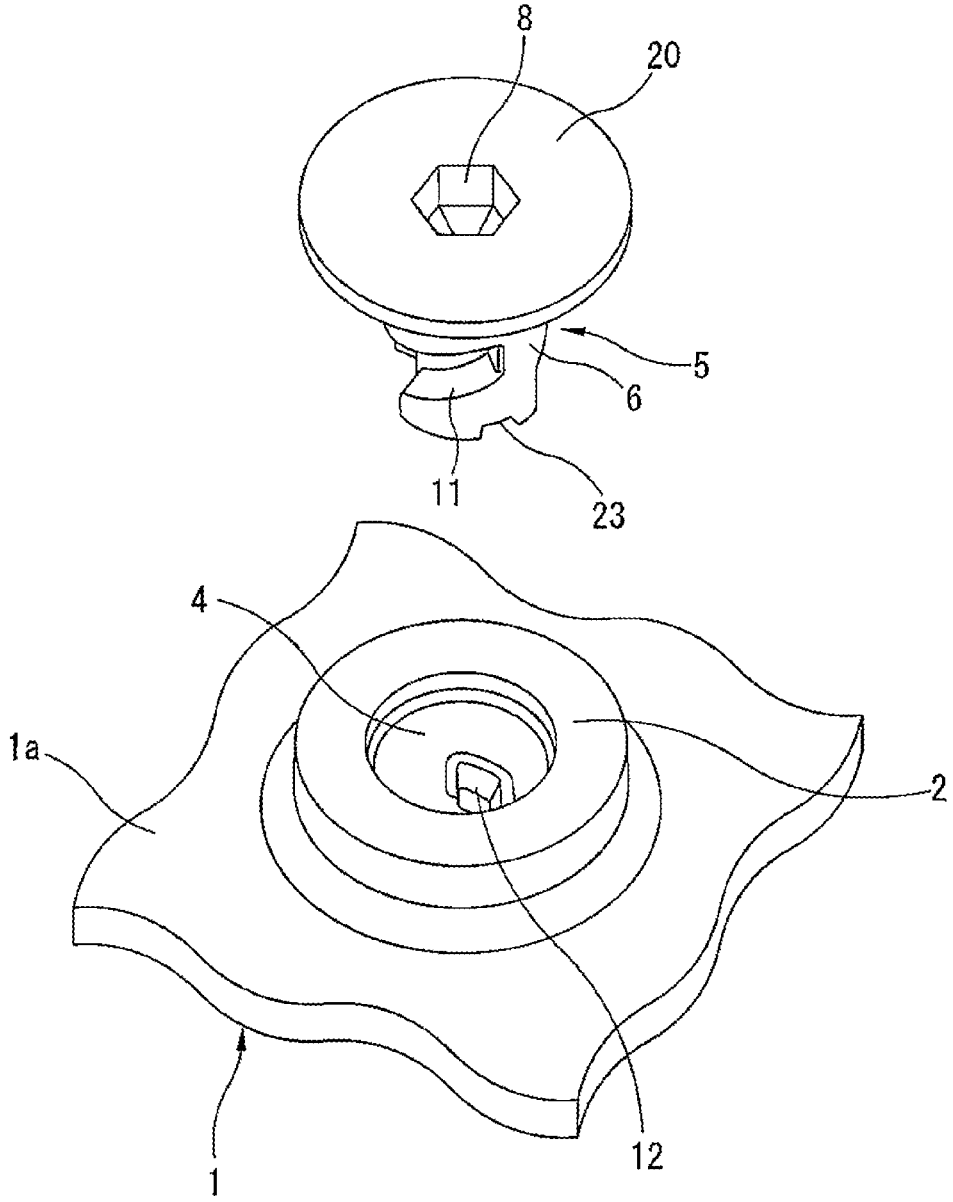

[Fig.10]
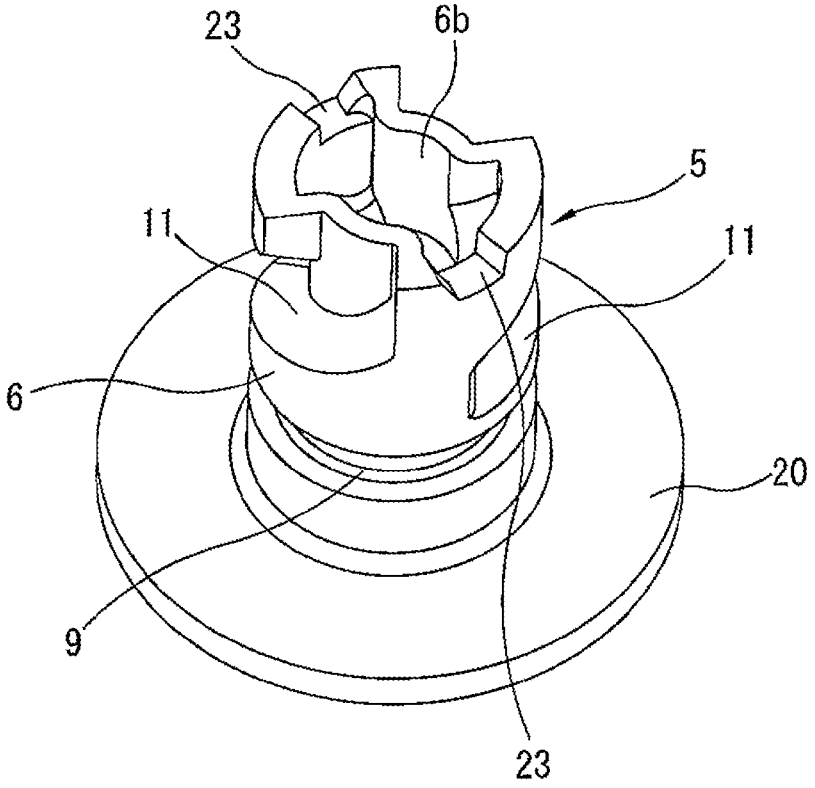

[Fig.11]
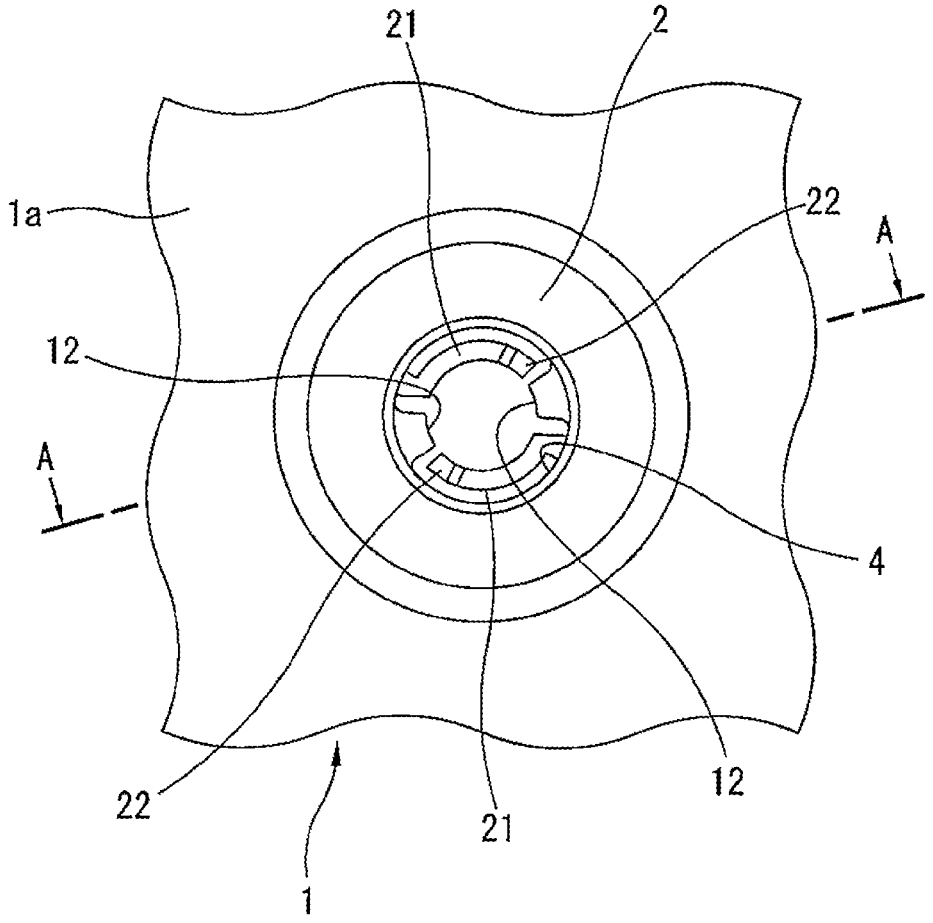

[Fig.12]
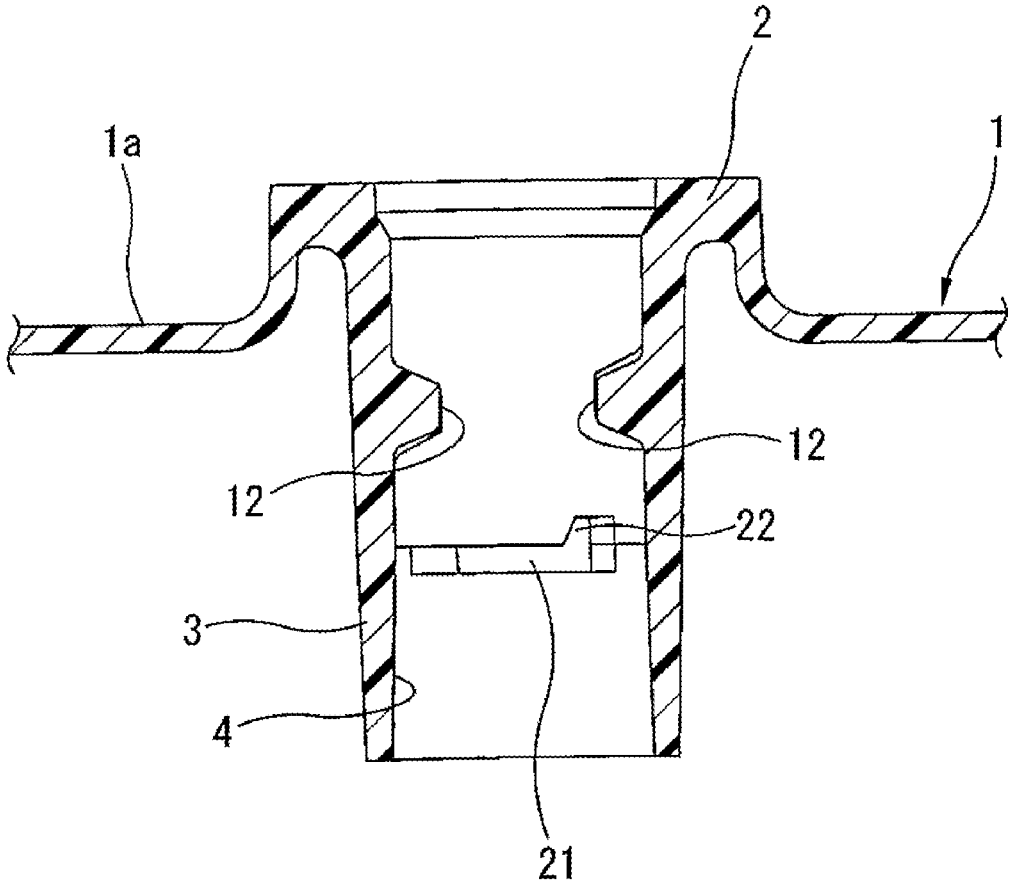

[Fig.13]
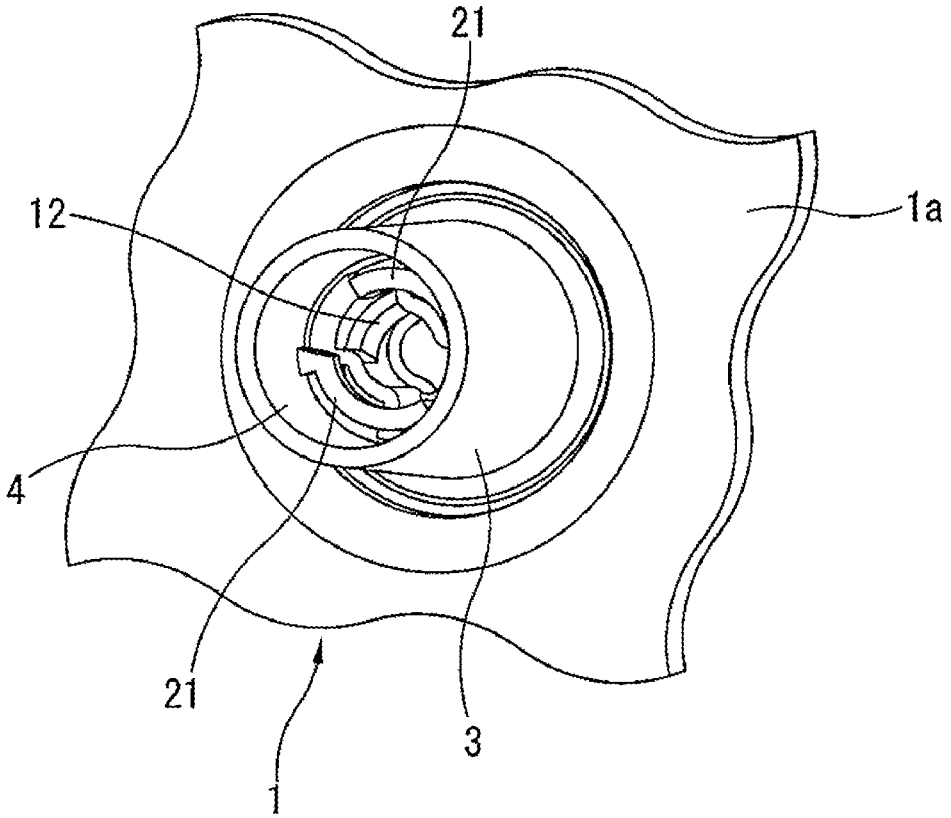

[Fig.14]
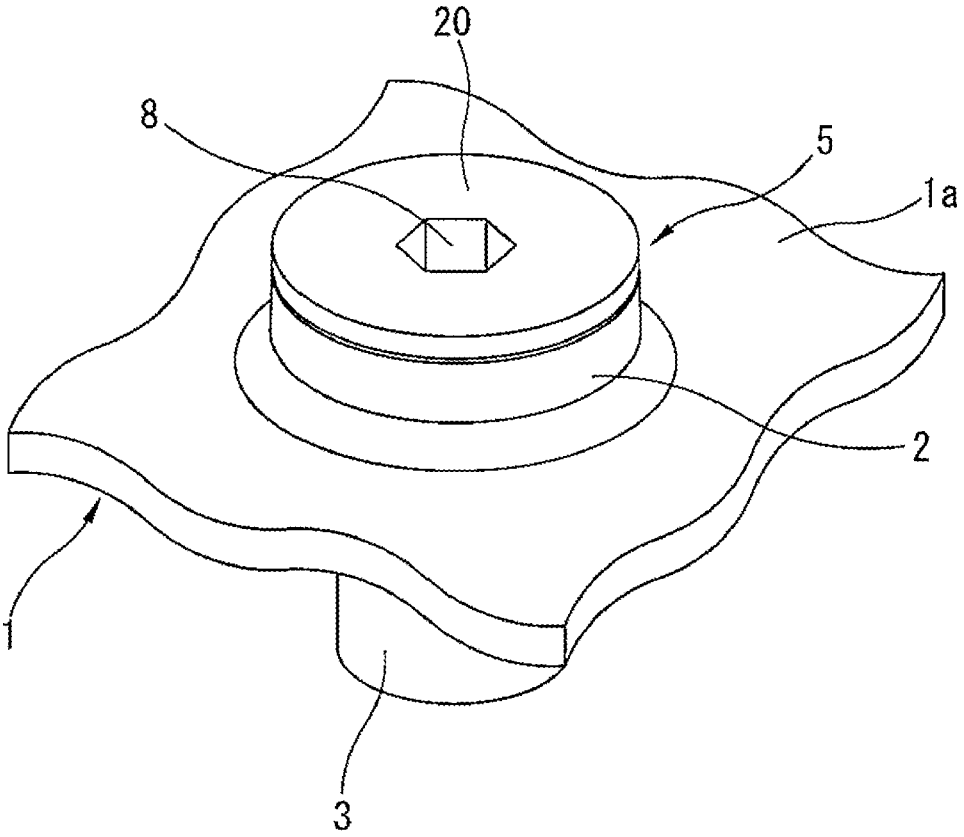

[Fig.15]
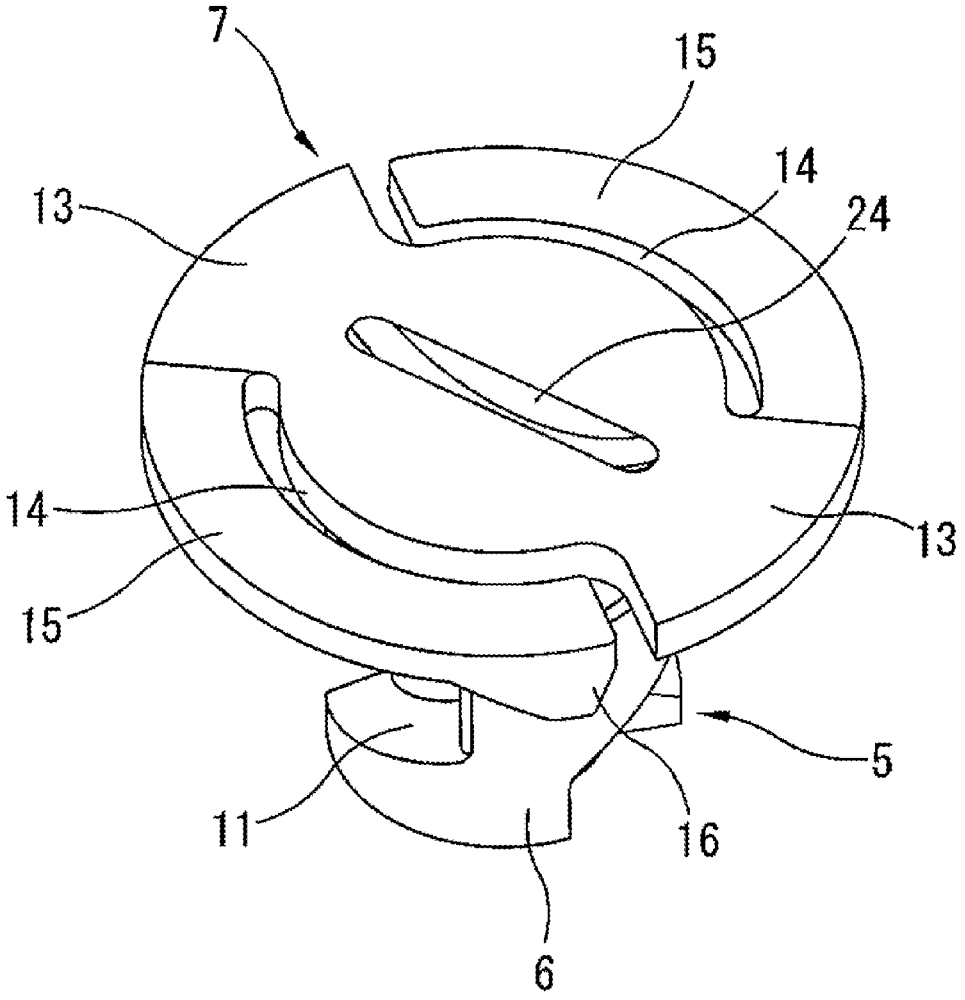

[Fig.16]
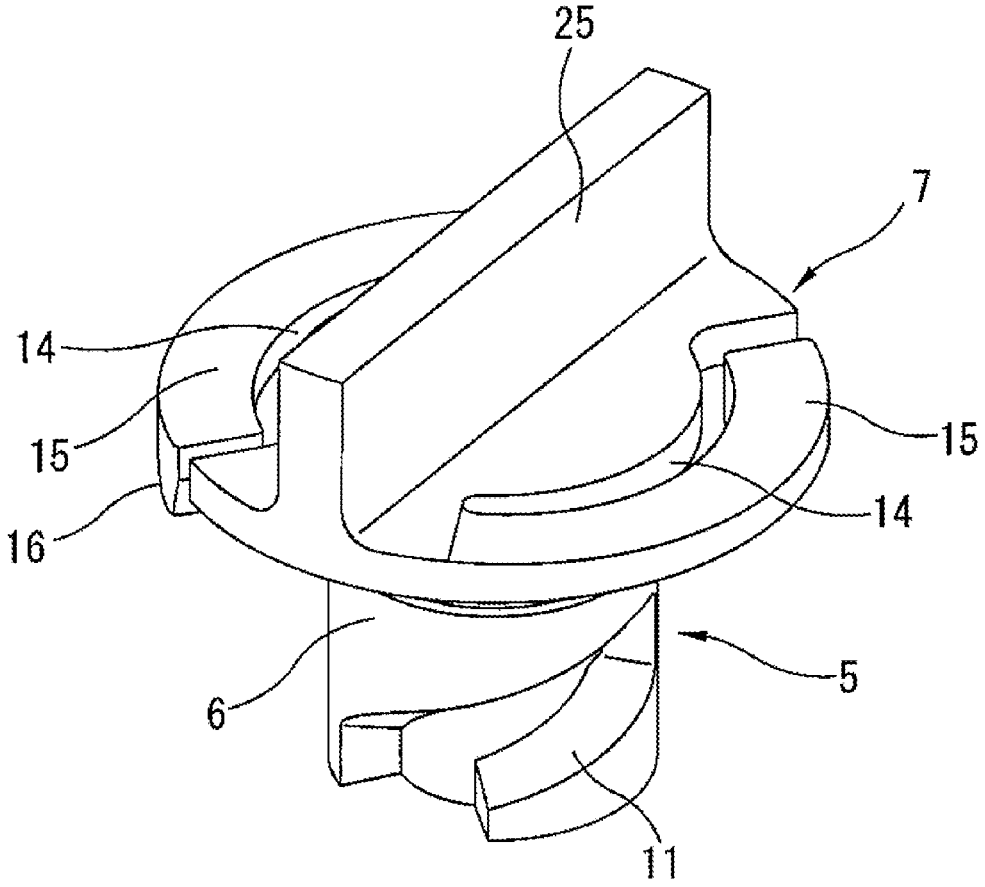

[Fig.17]
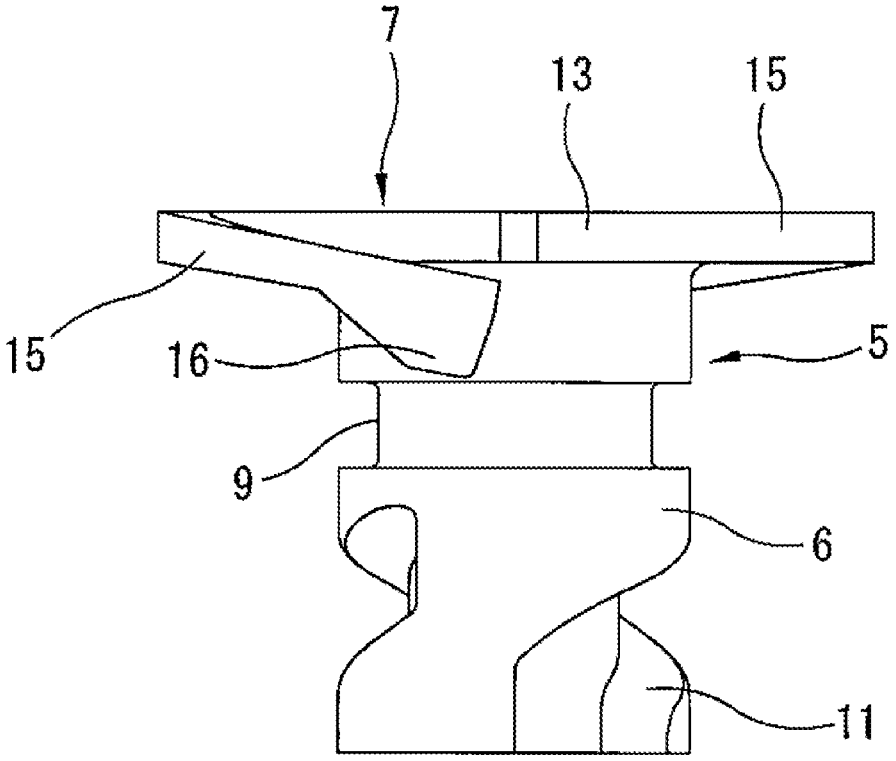

DRAIN PLUG STRUCTURE FOR OIL PAN

CROSS-REFERENCE TO RELATED APPLICATIONS

This application claims priority to International Patent Application No. PCT/EP2018/081876 filed on Nov. 20, 2018, and to Japanese Patent Application JP 2017-229900 filed on Nov. 30, 2017, the contents of each of which is hereby incorporated by reference in their entirety.

TECHNICAL FIELD

The present invention relates to a drain plug structure for an oil pan provided at a lower portion of an internal combustion engine, preferably of an automobile. The present invention also relates to an oil pan equipped with such a drain plug structure. Furthermore, the present invention also refers to an internal combustion engine equipped with such an oil pan.

BACKGROUND

As oil pans have come to be made of resin, there has also been a tendency to use a resin drain plug for closing off a drain hole in the oil pan, and Patent Document 1 describes a typical example of a resin drain plug which was proposed.

The drain plug structure disclosed in Patent Document 1 comprises, in summary, a columnar closure portion inserted into a drain hole, a sealing material provided on the closure portion, and a tool attachment/detachment portion and a flange provided on the closure portion in such a way as to face the outside of an oil pan, as shown in FIG. 1-5 of that document. A helical thread groove (cam groove) is formed on the closure portion, while a screw clasp (protrusion) able to screw together with the thread groove is formed on an inner circumferential surface of the drain hole.

When the drain plug is screwed in and inserted into the drain hole, the drain plug is drawn in by an advancing screwing action based on meshing of the thread groove and the screw clasp, and a sealing function afforded by the sealing material is demonstrated while a turning-restricting projection formed on a tip end surface of the drain hole engages with an engaging recess on the flange side so that a function to prevent loosening of the drain plug is demonstrated.

Patent Document 1: JP 2017-96190 A.

With the drain plug structure disclosed in Patent Document 1, however, when the drain plug is removed, the loosening-prevention function until that point is released for the first time as a result of the turning-restricting projection overcoming the engaging recess on the flange side by means of a reverse turning operation of the drain plug. The release of this loosening-prevention function depends greatly on the elastic strength of the turning-restricting projection itself, so there may be cases in which a shear friction force when the turning-restricting projection overcomes the engaging recess is large, and the turning-restricting projection is worn and crushed. Accordingly, there is a risk of it no longer being possible to demonstrate the intrinsic loosening-prevention function at the time of reinsertion, depending on the state of crushing of the turning-restricting projection, and there is still room for further improvement from the point of view of durability.

SUMMARY

The present invention focuses on the abovementioned problem, and provides a drain plug structure for an oil pan with which an excessive shear friction force is not exerted when a loosening-prevention function is released, and durability is improved in such a way that the loosening-prevention function is stably demonstrated even when the drain plug has been repeatedly attached and detached.

The present invention constitutes a detachable drain plug structure for closing off a drain hole formed in a bottom portion of an oil pan, said drain plug structure being characterized in that it comprises: a columnar stopper portion which is inserted into the drain hole and rotated in order to prevent withdrawal; a sealing member fitted to an outer periphery of the columnar stopper portion; an operating portion for the abovementioned rotation operation, which is formed on an outside exposed end portion of the columnar stopper portion; a plurality of cantilevered arcuate arm portions which are formed projecting radially outwards from the outside exposed end portion of the columnar stopper portion and are also arranged in series along a circumferential direction; and a loosening-prevention meshing portion which is formed on both a tip end portion of each arcuate arm portion and an opening edge portion of the drain hole, and demonstrates a loosening-prevention function by fitting together in a recess/projection engagement.

The arcuate arm portions may also be provided on the plughole side rather than on the drain plug side.

That is to say, the present invention may also constitute a detachable drain plug structure for closing off a drain hole formed in a bottom portion of an oil pan, said drain plug structure comprising: a columnar stopper portion which is inserted into the drain hole and rotated in order to prevent withdrawal; a sealing member fitted to an outer periphery of the columnar stopper portion; an operating portion for the abovementioned rotation operation, which is formed on an outside exposed end portion of the columnar stopper portion; a plurality of cantilevered arcuate arm portions which are formed projecting from an inner circumferential surface of the drain hole and are also arranged in series along a circumferential direction; and a loosening-prevention meshing portion which is formed on both a tip end portion of each arcuate arm portion and a tip end portion of the columnar stopper portion, and demonstrates a loosening-prevention function by fitting together in a recess/projection engagement.

Furthermore, as a preferred mode in either case, when the columnar stopper portion is rotated up to a rotation limit position at which the drain hole is closed off, both of the loosening-prevention meshing portions fit together in a recess/projection engagement.

Likewise, as a preferred mode, the drain plug is drawn into the drain hole as the drain plug rotates, as a result of engagement of a helical cam groove formed on either one of an inner circumferential surface of the drain hole or an outer circumferential surface of the columnar stopper portion, and a protrusion formed on the other thereof.

According to the present invention, a loosening-prevention function is demonstrated by virtue of the fact that one loosening-prevention meshing portion is formed at a tip end portion of the cantilevered arcuate arm portions and also fits together in a recess/projection engagement with another loosening-prevention meshing portion constituting a mating side for the one loosening-prevention meshing portion on the arcuate arm side. By this means, when the recess/projection engagement of both of the loosening-prevention meshing portions is released, elastic deformation can take place from a root portion of the cantilevered arcuate arm portions. An excessive shear friction force is therefore no longer exerted on the loosening-prevention meshing portions, and it is possible to suppress wear of the loosening-prevention meshing portions. As a result, a loosening-prevention function is stably demonstrated even when the drain plug has been repeatedly attached and detached, and the durability of the drain hole and the drain plug is improved.

BRIEF DESCRIPTION OF THE DRAWINGS

FIG. 1 shows a first mode of embodiment of the drain plug structure for an oil pan according to the present invention, and is a view in cross section of the main parts including the drain hole formed at the bottom portion of the oil pan, and the drain plug.

FIG. 2 is an exploded oblique view in a state in which FIG. 1 has been vertically inverted.

FIG. 3 is an enlarged oblique view in a state in which the drain plug shown in FIG. 2 has been vertically inverted.

FIG. 4 is an oblique view when the drain plug has been tightened from the state in FIG. 2.

FIG. 5 is an enlarged explanatory diagram of the main parts, showing a meshed state in which the engaging projection on the arcuate arm portion side shown in FIG. 4 is fitted together by a recess/projection engagement with the engaging recess on a seat portion side of the oil pan.

FIG. 6 shows a second mode of embodiment of the drain plug structure for an oil pan according to the present invention, and is an exploded oblique view of the same position as in FIG. 2.

FIG. 7 is an enlarged oblique view in a state in which the drain plug shown in FIG. 6 has been vertically inverted.

FIG. 8 is an oblique view when the drain plug has been tightened from the state in FIG. 6.

FIG. 9 shows a third mode of embodiment of the drain plug structure for an oil pan according to the present invention, and is an exploded oblique view of the same position as in FIG. 2.

FIG. 10 is an enlarged oblique view of a state in which the drain plug shown in FIG. 9 has been vertically inverted.

FIG. 11 is a plan view of the drain hole shown in FIG. 9.

FIG. 12 is a view in cross section along the line A-A in FIG. 11.

FIG. 13 is an oblique view in which the drain hole shown in FIG. 12 is seen from obliquely below in that drawing.

FIG. 14 is an oblique view when the drain plug has been tightened from the state in FIG. 9.

FIG. 15 shows a fourth mode of embodiment of the drain plug structure for an oil pan according to the present invention, and is an oblique view of the drain plug alone.

FIG. 16 shows a fifth mode of embodiment of the drain plug structure for an oil pan according to the present invention, and is an oblique view of the drain plug alone.

FIG. 17 shows a sixth mode of embodiment of the drain plug structure for an oil pan according to the present invention, and is a side view of the drain plug.

DETAILED DESCRIPTION

FIG. 1-5 show a more specific first mode for implementing the drain plug structure for an oil pan according to the present invention, and in particular FIG. 1 shows a view in cross section of the main parts including a drain hole 4 formed on a bottom portion of an oil pan 1, and a drain plug 5. Furthermore, FIG. 2 shows an exploded oblique view in a state in which FIG. 1 has been vertically inverted, and FIG. 3 shows an enlarged oblique view in a state in which the drain plug 5 shown in FIG. 2 has been vertically inverted. In addition, FIG. 4 shows an oblique view when the drain plug 5 has been tightened from the state in FIG. 2.

As shown in FIG. 1, an annular and thick-walled seat portion 2 is formed on a bottom portion of the resin oil pan 1 in such a way as to protrude by a predetermined amount from a bottom surface 1*a*. Furthermore, a hollow cylindrical boss portion 3 protruding towards an oil receiving space is formed as a single piece on the inside of the seat portion of the oil pan 1, and an inner circumference of the boss portion 3 forms the drain hole 4. The resin drain plug 5 is detachably fitted into the drain hole 4 from the outside, whereby the drain hole 4 is closed off by the drain plug 5 in such a way that oil does not leak except during an oil change.

The drain plug 5 shown in FIG. 1 and FIG. 2 is broadly formed by: a substantially cylindrical columnar stopper portion 6 such as to substantially fill the space of the drain hole 4 when inserted into said drain hole 4; and a seating flange portion 7 which is formed as a single piece with one end portion 6*a* of the columnar stopper portion 6 in such a way as to project radially therefrom, and is larger in diameter than said one end portion 6*a* and has a top portion of predetermined thickness. It should be noted that the one end portion 6*a* of the columnar stopper portion 6 with which the seating flange portion 7 is formed as a single piece is exposed to the exterior together with the seating flange portion 7 when the drain plug 5 is fitted in the drain hole 4, so said one end portion 6*a* is referred to as the outside exposed end portion in the following description.

As shown in FIG. 1 and FIG. 2, a hexagonal tool hole 8 functioning as an operating portion and provided for a rotation operation of the drain plug 5 afforded by a tool such as a hexagon key wrench, for example, is formed in a central portion of the seating flange portion 7 including the outside exposed end portion 6*a* of the columnar stopper portion 6. Furthermore, an irregularly-shaped cavity 6*b* is formed on a tip end surface of the columnar stopper portion 6 on the opposite side to the seating flange portion 7, as shown in FIG. 3.

As shown in FIG. 1 and FIG. 3, a polygonal groove-shaped circumferential groove 9 is formed at a substantially intermediate portion in a lengthwise direction on an outer circumferential surface of the columnar stopper portion 6 of the drain plug 5, and an O-ring 10 serving as a sealing member is fitted into said circumferential groove 9, as shown in FIG. 1. It should be noted that the actual O-ring 10 is omitted in FIG. 3.

Furthermore, two helical cam grooves 11 likewise having a polygonal groove shape are independently formed in such a way as not to interfere with each other in proximity to the circumferential groove 9 on the outer circumferential surface of the columnar stopper portion 6. These two helical cam grooves 11 are formed over a length of less than 180° in the circumferential direction, and both cam grooves 11 should be considered as not overlapping in the circumferential direction. As shown in FIG. 3, a start end portion and a terminal end portion of each cam groove 11 form vertical wall surfaces 11*a*, 11*b* at right angles to a bottom surface of the groove space of the cam groove 11, and a range over which the drain plug 5 can be rotated is defined by these two vertical wall surfaces 11*a*, 11*b*. It should be noted that the two helical cam grooves 11 may also be understood as thread grooves, and here they are formed as right-hand thread type grooves, for example.

As shown in FIG. 1 and FIG. 2, a pair of protrusions 12 which are engageable with the cam grooves 11 on the drain plug 5 side are formed facing each other on the inner circumferential surface of the drain hole 4, correspondingly with said cam grooves 11. Accordingly, as will be described later, the columnar stopper portion 6 of the drain plug 5 is inserted into the drain hole 4, and once the start end portions of the cam grooves 11 on the drain plug 5 side have been aligned with the protrusions 12 on the drain hole 4 side, the drain plug 5 is rotated by a predetermined amount in a clockwise direction, whereby the drain plug 5 is drawn to the drain hole 4 side commensurately with the lead of the cam grooves 11. It should be noted that the relative positional relationship of the pair of cam grooves 11 and the pair of protrusions 12 may equally be reversed.

Meanwhile, the seating flange portion 7 which is formed in such a way as to project outwards from the outside exposed end portion 6*a* of the columnar stopper portion 6 has a shape which is equally divided by means of four slot grooves 14 having a roughly deformed "<" shape such as to leave bridge portions 13 at four locations in the circumferential direction, and said seating flange portion 7 is slotted in a radial direction and the circumferential direction. As a result, the seating flange portion 7 is formed as four arcuate arm portions 15 which are cantilevered and have a circular arc shape, arranged in series along the circumferential direction, while the four bridge portions 13 remain as a base portion or a root portion. The circumferential length of the arcuate arm portions 15 which is slotted by the slot grooves 14 is sufficiently large to provide adequate flexibility in a thickness direction with the bridge portions 13 as a support point, and the structure enables elastic deformation based on the elastic strength thereof in the thickness direction.

As shown in the enlargement of FIG. 3 which illustrates the rear surface of the arcuate arm portions 15, engaging projections 16 which are approximately crest-shaped are formed at tip end portions on the rear surfaces of the arcuate arm portions 15. As shown in the enlargement of FIG. 5, the engaging projections 16 comprise: a flat top portion 16*a* parallel to the actual rear surface of the arcuate arm portions 15; an inclined surface 16*b* having a relatively gentle inclination gradient from the top portion 16*a* towards the root portion or base portion side of the corresponding arcuate arm portion 15; and an inclined surface 16*c* having a steep inclination gradient which is formed between a tip end surface 15*a* and the top portion 16*a* of the corresponding arcuate arm portion 15.

Meanwhile, as shown in FIG. 1 and FIG. 2, the annular seat portion 2 formed on the bottom surface 1*a* of the oil pan 1 is formed with a size such as to enable seating (including seating with a slight gap) of the arcuate arm portions 15 on the drain plug 5 side when the drain plug 5 is fitted in the drain hole 4. Engaging recesses 17 enabling engagement of the engaging projections 16 on the arcuate arm portions 15 are then formed at four locations in the circumferential direction of the seat portion 2.

As shown in the enlargement of FIG. 5, the engaging recesses 17 are formed with a similar shape to that of the engaging projections 16 on the arcuate arm portion 15 side, and comprise: a bottom surface 17*a* parallel to an upper surface of the seat portion 2; an inclined surface 17*b* having substantially the same inclination gradient as the inclined surfaces 16*b* on the engaging projection 16 side; and an inclined surface 17*c* likewise having substantially the same inclination gradient as the other inclined surface 16*c* on the engaging projection 16 side. An angle θ of both inclined surfaces 16*c*, 17*c* is set at less than 90°.

As shown in FIG. 4 (to be described later) in addition to FIG. 1, in a state of normal fitting of the drain plug 5 into the drain hole 4, the arcuate arm portions 15 on the drain plug 5 side are seated on the seat portion 2, while the engaging projections 16 of the arcuate arm portions 15 engage separately with the engaging recesses 17 of the seat portion 2 constituting a mating side, and what is known as a loosening-prevention function of the drain plug 5 is demonstrated. Accordingly, the engaging projections 16 on the arcuate arm portion 15 side and the corresponding engaging recesses 17 on the seat portion 2 side fit together in a recess/projection engagement, and thereby function as loosening-prevention meshing portions that demonstrate a function of preventing loosening of the drain plug 5.

Accordingly, the following procedure is used with the drain plug 5 structure for the oil pan 1 having the above configuration when the drain plug 5 is fitted in the drain hole 4.

As shown in FIG. 2, when the columnar stopper portion 6 of the drain plug 5 has been inserted into the drain hole 4, a tool such as a hexagon key wrench which fits together with the tool hole 8 serving as an operating portion is used to rotate the drain plug 5 slightly forwards and backwards, and alignment of the protrusions 12 on the drain hole 4 side with the start end portions of the cam grooves 11 on the drain plug 5 side is confirmed.

When it has been possible to confirm alignment of the protrusions 12 on the drain hole 4 side with the start end portions of the cam grooves 11 on the drain plug 5 side, the drain plug 5 is rotated in a clockwise direction while that state is maintained. As this rotation operation takes place, the drain plug 5 is gradually drawn to the drain hole 4 side in accordance with the lead of the cam grooves 11, and as shown in FIG. 1, the O-ring 10 fitted in advance to the columnar stopper portion 6 of the drain plug 5 suitably flexes and deforms between the columnar stopper portion 6 and the inner circumferential surface of the drain hole 4. As a result, a sealing function is demonstrated by the O-ring 10, together with closure of the drain hole 4.

Then, when the protrusions 12 on the drain hole 4 side abut the vertical wall surfaces 11*b* constituting the terminal end portions of the cam grooves 11 on the drain plug 5 side shown in FIG. 3, the vertical wall surfaces 11*b* function as a stopper surface and prevent a further rotation operation of the drain plug 5.

In this case, the engaging projections 16 at the tip ends of the arcuate arm portions 15 shown in FIG. 2 abut the upper surface of the seat portion 2, from a position a predetermined amount before abutment of the protrusions 12 on the drain hole 4 side with the vertical wall surfaces 11*b* of the cam grooves 11, and the arcuate arm portions 15 flex and deform from the root portion or base portion in such a way as to lift up from the seat portion 2 under their own elastic strength, while the arcuate arm portions 15 also slide and move over the seat portion 2 as the drain plug 5 rotates. When the positions of the engaging projections 16 on the arcuate arm portion 15 side and of the engaging recesses 17 on the seat 2 side are aligned, the engaging projections 16 then drop into the engaging recesses 17 so that they fit together in what is known as a recess/projection engagement.

To be more specific, as already described, the drain plug 5 is of the right-hand thread type and is screwed into the drain hole 4 as a result of clockwise rotation in FIG. 2, so the inclined surfaces 16*c* of the engaging projections 16 at the tip end portions of the arcuate arm portions 15 slide down the inclined surfaces 17*c* on the engaging recess 17 side, whereby the engaging projections 16 and the engaging recesses 17 are fitted together instantly in a recess/projection engagement. Then, as shown in FIG. 4, the engaging projections 16 on the arcuate arm portion 15 side and the engaging recesses 17 on the seat portion 2 side fit together in a recess/projection engagement, and the portions outside of the engaging projections 16 on the arcuate arm portions 15 are seated on the seat portion 2, whereby fitting of the drain plug 5 to close off the drain hole 4 is completed, and a function of preventing loosening of the drain plug 5 is demonstrated at the same time.

In this case, at the instant at which the engaging projections 16 on the arcuate arm portions 15 slide down the inclined surfaces 17*c* having a steep inclination gradient of the engaging recesses 17 on the seat portion 2 side, a striking sound of the recess/projection engagement of the two is produced and a sense of easing is obtained, so there is no excessive tightening of the drain plug 5.

Furthermore, in regard to the function of preventing loosening of the drain plug 5, there is no loosening unless the drain plug 5 is turned in the opposite direction to the clockwise direction (the counterclockwise direction) and the engaging projections 16 on the arcuate arm portion 15 side overcome the inclined surfaces 17*c* having a steep inclination gradient of the engaging recesses 17 on the seat portion 2 side. The reliability of the loosening-prevention function is therefore increased and it is possible to prevent inadvertent loosening of the drain plug 5 before it happens, so a state of closure of the drain hole 4 afforded by the drain plug 5 can be stably maintained.

Meanwhile, when the drain plug 5 is removed, the drain plug 5 shown in FIG. 4 is rotated in the opposite direction to the clockwise direction (the counterclockwise direction), but what little force is applied to withdrawal of the engaging projections 16 from the engaging recesses 17 results from inclined surface contact between the inclined surfaces 16*c* of the engaging projections 16 and the inclined surfaces 17*c* of the engaging recesses 17 on the seat portion 2 side. In this way, the arcuate arm portions 15 flex and deform in such a way as to lift up from the seat portion 2, and the engaging projections 16 are shaped in such a way as to run over the upper surface of the seat portion 2.

In this mode of embodiment, the peripheral length and wall thickness of the arcuate arm portions 15 are set in such a way as to take account of the torque required when the drain plug 5 is removed (loosened) and the amount of flexing and deformation etc. of the arcuate arm portions 15 required to engage/disengage the engaging projections 16 and the engaging recesses 17, so the operations do not lead to damage to the drain plug 5 or the protrusions 12 on the drain hole 4 side, and repeated usage is possible.

Furthermore, as is clear from FIG. 1, the diameter of the hexagonal tool hole 8 functioning as the operating portion is set to be smaller than the diameter of the columnar stopper portion 6 at the location where the vertical wall surfaces 11*b* of the cam grooves 11, which are abutted by the protrusions 12 on the drain hole 4 side and function as a stopper when the drain plug 5 is tightened, are formed. Consequently, even if the drain plug 5 were to be excessively tightened using the hexagon key wrench or the like, for example, the tool hole 8 would be damaged before the protrusions 12 snapped at the abutment between the protrusions 12 and the vertical wall surfaces 11*b*. Only the drain plug 5 would therefore need to be replaced.

According to this mode of embodiment as described above, the engaging projections 16 functioning as one loosening-prevention meshing portion are formed at the tip end portions of the cantilevered arcuate arm portions 15 of the drain plug 5, and a loosening-prevention function is demonstrated as a result of the engaging projections 16 on the arcuate arm portion 15 side fitting together in a recess/projection engagement with the engaging recesses 17 on the seat portion 2 side functioning as the mating-side other loosening-prevention meshing portions, so when the recess/projection engagement of the engaging projections 16 and the engaging recesses 17 is released, the cantilevered arcuate arm portions 15 can elastically deform from the root portion or base portion thereof. Consequently, an excessive shear friction force is not applied to the engaging projections 16 or the engaging recesses 17 for preventing loosening, and wearing thereof can be suppressed. As a result, the loosening-prevention function is stably demonstrated even when the drain plug 5 has been repeatedly attached and detached, and the durability of the drain hole 4 and the drain plug 5 is improved.

FIG. 6-8 show a second mode of embodiment of the drain plug structure for an oil pan according to the present invention, and elements which are common to the first mode of embodiment already described bear the same reference symbols. It should be noted that FIG. 6-8 correspond to the previous FIG. 2-4, respectively.

According to the second mode of embodiment, as shown in FIG. 6-8, there are two arcuate arm portions 15 on the seating flange portion 7 at the top portion of the drain plug 5, and engaging recesses 18 functioning as the loosening-prevention meshing portions are formed at the tip end portions on the rear surfaces of the arcuate arm portions 15. Meanwhile, a pair of engaging projections 19 which fit together with the engaging recesses 18 on the arcuate arm portion 15 side in a recess/projection engagement and likewise function as loosening-prevention meshing portions are formed on the seat portion 2 on the bottom surface 1*a* of the oil pan 1. The shapes of the engaging recesses 18 and the engaging projections 19 are substantially the same as those shown in FIG. 5.

The second mode of embodiment differs from the first mode of embodiment only in that the number of engaging recesses 18, engaging projections 19, and also arcuate arm portions 15, is reduced to two in each case, and the relative positional relationship of the engaging recesses 18 on the arcuate arm portion 15 side and the engaging projections 19 on the seat portion 2 side is reversed. Accordingly, this mode of embodiment also demonstrates the same advantages as in the first mode of embodiment.

FIG. 9-14 show a third mode of embodiment of the drain plug structure for an oil pan according to the present invention, and elements which are common to the first mode of embodiment already described bear the same reference symbols. FIGS. 9 and 10 correspond to the previous FIGS. 2 and 3, respectively. Furthermore, FIG. 11 is a plan view of the drain hole 4 shown in FIG. 9, and FIG. 12 is a view in cross section along the line A-A in FIG. 11. In addition, FIG. 13 is an oblique view in which the drain hole 4 shown in FIG. 12 is seen from obliquely below in that drawing.

According to the third mode of embodiment, as shown in FIGS. 9 and 10, rather than the arcuate arm portions being formed on a seating flange portion 20 at the top portion of the drain plug 5, the seating flange portion 20 itself is formed as a simple disk-shaped element, while as shown in FIG. 11-13, a pair of arcuate arm portions 21 curved in a circular arc shape are formed projecting further towards the interior side of the inner circumferential surface of the drain hole 4 than the protrusions 12. The arcuate arm portions 21 are cantilevered arcuate components in the same way as in the previous first and second modes of embodiment. Engaging projections 22 functioning as loosening-prevention meshing portions are formed at the tip end portions of the arcuate arm portions 21. It should be noted that the upper surface of the seating portion 2 shown in FIGS. 9 and 12 is a simple flat surface.

Meanwhile, as shown in FIGS. 9 and 10, a pair of engaging recesses 23 functioning as a loosening-prevention meshing portion able to fit together with the abovementioned engaging projections 22 in a recess/projection engagement are formed on the tip end surface of the columnar stopper portion 6 of the drain plug 5. The shapes of the engaging projections 22 and the engaging recesses 23 are substantially the same as those shown in FIG. 5. Moreover, as is clear from FIGS. 11 and 13, the positions of the pair of protrusions 12 and the pair of arcuate arm portions 21 are taken into account such that the two do not overlap in position in the circumferential direction.

Accordingly, in the third mode of embodiment, the engaging recesses 23 on the drain plug 5 side and the engaging projections 22 attached to the arcuate arm portions 21 on the drain hole 4 side fit together in a recess/projection engagement at the end of the process to tighten the drain plug 5 based on engagement of the cam grooves 11 on the drain plug 5 side and the protrusions 12 on the drain hole 4 side. FIG. 14 shows a state in which the drain plug 5 is correctly fitted from the state in FIG. 9. As a result, this mode of embodiment demonstrates the same advantages as in the first mode of embodiment.

FIGS. 15 and 16 show variant examples of the seating flange portion 7 at the top portion of the columnar stopper portion 6 of the drain plug 5, as fourth and fifth modes of embodiment of the drain plug structure for an oil pan according to the present invention. Here, elements which are common to the first mode of embodiment shown in FIG. 2 bear the same reference symbols.

In the fourth mode of embodiment shown in FIG. 15, there are two of the arcuate arm portions 15 on the seating flange portion 7 at the top portion of the drain plug 5, while a coin groove 24 which can be engaged by a coin or a portion of a coin-like disk-shaped tool is formed instead of the hexagonal tool hole 8 shown in FIG. 2. The coin groove 24 also functions as an operating portion for the rotation operation afforded by the tool.

Furthermore, in the fifth mode of embodiment shown in FIG. 16, there are two arcuate arm portions 15 on the seating flange portion 7 at the top portion of the drain plug 5, while a knob portion 25 having what is known as a minus-shaped protrusion is formed instead of the hexagonal tool hole 8 shown in FIG. 2. This knob portion 25 also functions as an operating portion for the rotation operation afforded by a manual operation.

The coin groove 24 and the knob portion 25 serving as the operating portion may also be used, as required, in the second and third modes of embodiment shown in FIGS. 6 and 9.

FIG. 17 shows a variant example of the arcuate arm portions 15 on the seating flange portion 7 of the drain plug 5, as a sixth mode of embodiment of the present invention. It should be noted that elements which are common to FIG. 15 bear the same reference symbols.

As shown in FIG. 17, a pair of arcuate arm portions 15 on the seating flange portion 7 of the drain plug 5 are formed in such a way that in a free state thereof, they are bent downwards in the drawing beforehand from a root portion or base portion corresponding to the bridge portions 13. This offers an advantage in that it is possible to ensure a large amount of upward flexing and deformation of the arcuate arm portions 15 based on flexing and deformation thereof when the engaging projections 16 at the tip ends of the arcuate arm portions 15 run over the seat portion 2 around the drain hole 4 constituting the mating side and are seated thereon. When the engaging projections 16 at the tip ends of the arcuate arm portions 15 are aligned with the engaging recesses 17 on the mating side, they are fitted together in a recess/projection engagement at the attitude in FIG. 17. As a result, an engaging noise can be sounded to the operator, indicating that the engaging projections 16 and the engaging recesses 17 have securely engaged.

The shapes of these arcuate arm portions 15 which are used may also be those in the fifth mode of embodiment shown in FIG. 16, in addition to those of the first and second modes of embodiment shown in FIGS. 2 and 6, as required.

The invention claimed is:

1. A drain plug structure for an oil pan, which is a detachable drain plug structure for closing off a drain hole disposed in a bottom portion of the oil pan, said drain plug structure comprising:

a columnar stopper portion inserted into the drain hole and rotated to prevent withdrawal;

a sealing member fitted to an outer periphery of the columnar stopper portion;

an operating portion for a rotation operation disposed on an outside exposed end portion of the columnar stopper portion;

four arcuate arm portions projecting radially outwards from the outside exposed end portion of the columnar stopper portion and arranged in series along a circumferential direction;

a loosening-prevention meshing portion disposed on both a tip end portion of each arcuate arm portion and an opening edge portion of the drain hole, and demonstrates a loosening-prevention function by fitting together in a recess/projection engagement; and a seating flange portion provided as a single piece with one end portion of the columnar stopper portion and projecting radially therefrom, the seating flange portion is larger in diameter than said one end portion and has a top portion of predetermined thickness;

wherein the seating flange portion has a shape that is equally divided via four slot grooves having a roughly deformed "<" shape such as to leave bridge portions at four locations in the circumferential direction, and said seating flange portion is slotted in a radial direction and the circumferential direction to form the four arcuate arm portions that are cantilevered and have a circular arc shape, arranged in series along the circumferential direction, and the four bridge portions remain as a root portion;

wherein the circumferential length of the arcuate arm portions is sufficiently large to provide adequate flexibility in a thickness direction with the bridge portions as a support point, and the structure enables elastic deformation based on the elastic strength thereof in the thickness direction; and wherein a peripheral length and a wall thickness of the four arcuate arm portions are set to take account of the torque required when the drain plug is removed and the amount of flexing and deformation of the arcuate arm portions required to engage/disengage the recess/projection engagement, so the operations do not lead to damage and repeated usage is possible; and wherein the four arcuate arm portions include engaging projections respectively disposed at a tip end portion on a rear surface of the four arcuate arm portions, and wherein the wall thickness of the four arcuate arm portions is greater at the tip end portion than at a base portion connected to the four bridge portions and wherein the engaging projections each comprise a flat top portion parallel to the rear surface, a first inclined surface extending from the flat top portion towards the root portion defined by the four bridge portions, and a second inclined surface disposed between the flat top portion and a tip end surface of the corresponding one of the four arcuate arm portions.

2. The drain plug structure as claimed in claim 1, wherein, when the columnar stopper portion is rotated up to a rotation limit position at which the drain hole is closed off, both of the loosening-prevention meshing portions fit together in the recess/projection engagement.

3. The drain plug structure as claimed in claim 2, wherein the drain plug is drawn into the drain hole as the drain plug rotates, as a result of engagement of a helical cam groove disposed on one of an inner circumferential surface of the drain hole and an outer circumferential surface of the columnar stopper portion, and a protrusion is disposed on the other of the inner circumferential surface and the outer circumferential surface.

4. The drain plug structure as claimed in claim 3, wherein the oil pan in which the drain hole is disposed and the drain plug are both made of a resin.

5. The drain plug structure as claimed in claim 1, wherein the second inclined surface has a greater incline relative to the flat top portion than the first inclined surface.

6. An oil pan for an internal combustion engine, comprising: a detachable drain plug structure for closing off a drain hole disposed in a bottom portion of the oil pan, the detachable drain plug structure including:

a columnar stopper portion inserted into the drain hole and rotated to prevent withdrawal;

a sealing member fitted to an outer periphery of the columnar stopper portion;

an operating portion for a rotation operation disposed on an outside exposed end portion of the columnar stopper portion;

a plurality of cantilevered arcuate arm portions projecting radially outwards from the outside exposed end portion of the columnar stopper portion and arranged in series along a circumferential direction;

a loosening-prevention meshing portion disposed on both a tip end portion of each arcuate arm portion and an opening edge portion of the drain hole, and demonstrates a loosening-prevention function by fitting together in a recess/projection engagement; and a seating flange portion provided as a single piece with one end portion of the columnar stopper portion and projecting radially therefrom, the seating flange portion is larger in diameter than said one end portion and has a top portion of predetermined thickness;

wherein the seating flange portion has a shape that is equally divided via four slot grooves having a roughly deformed "<" shape such as to leave bridge portions at four locations in the circumferential direction, and said seating flange portion is slotted in a radial direction and the circumferential direction to form the plurality of cantilevered arcuate arm portions into four arcuate arm portions that are cantilevered and have a circular arc shape, arranged in series along the circumferential direction, and the four bridge portions remain as a root portion;

wherein the circumferential length of the four arcuate arm portions is sufficiently large to provide adequate flexibility in a thickness direction with the bridge portions as a support point, and the structure enables elastic deformation based on the elastic strength thereof in the thickness direction;

wherein a peripheral length and a wall thickness of the four arcuate arm portions are set to take account of the torque required when the drain plug is removed and the amount of flexing and deformation of the four arcuate arm portions required to engage/disengage the recess/projection engagement, so the operations do not lead to damage and repeated usage is possible; and wherein the four arcuate arm portions include engaging projections respectively disposed at a tip end portion on a rear surface of the four arcuate arm portions, and wherein the engaging projections each comprise a flat top portion parallel to the rear surface, a first inclined surface extending from the flat top portion towards the root portion defined by the four bridge portions, and a second inclined surface disposed between the flat top portion and a tip end surface of the corresponding one of the four arcuate arm portions.

7. The oil pan as claimed in claim 6, wherein, when the columnar stopper portion is rotated up to a rotation limit position at which the drain hole is closed off, both of the loosening-prevention meshing portions fit together in the recess/projection engagement.

8. The oil pan as claimed in claim 7, wherein the drain plug is drawn into the drain hole as the drain plug rotates, as a result of engagement of a helical cam groove disposed on one of an inner circumferential surface of the drain hole and an outer circumferential surface of the columnar stopper portion, and a protrusion is disposed on the other of the inner circumferential surface of the drain hole and the outer circumferential surface of the columnar stopper portion.

9. The oil pan as claimed in claim 8, wherein the oil pan in which the drain hole is disposed and the drain plug are both made of a resin.

10. The oil pan as claimed in claim 6, wherein the second inclined surface has a greater incline relative to the flat top portion than the first inclined surface.

11. The oil pan as claimed in claim 6, wherein the wall thickness of the four arcuate arm portions is greater at the tip end portion than at a base portion connected to the four bridge portions.

12. The oil pan as claimed in claim 6, wherein the bottom portion of the oil pan has an annular seat portion that includes four engaging recesses for engaging with the four arcuate arm portions, wherein the four engaging recesses each comprise a flat bottom surface parallel to an upper surface of the annular seat portion, and a first inclined surface and a second inclined surface having a different inclination from one another.

13. An internal combustion engine, comprising: an oil pan provided at a lower portion thereof, the oil pan including a detachable drain plug structure for closing off a drain hole disposed in a bottom portion of the oil pain, the detachable drain plug structure including:

a columnar stopper portion inserted into the drain hole and rotated to prevent withdrawal;

a sealing member fitted to an outer periphery of the columnar stopper portion;

an operating portion for a rotation operation disposed on an outside exposed end portion of the columnar stopper portion;

a plurality of cantilevered arcuate arm portions projecting radially outwards from the outside exposed end portion of the columnar stopper portion and arranged in series along a circumferential direction;

a loosening-prevention meshing portion disposed on both a tip end portion of each arcuate arm portion and an opening edge portion of the drain hole, and demonstrates a loosening-prevention function by fitting together in a recess/projection engagement; and a seating flange portion provided as a single piece with one end portion of the columnar stopper portion and projecting radially therefrom, the seating flange portion is larger in diameter than said one end portion and has a top portion of predetermined thickness;

wherein the seating flange portion has a shape that is equally divided via four slot grooves having a roughly deformed "<" shape such as to leave bridge portions at four locations in the circumferential direction, and said seating flange portion is slotted in a radial direction and the circumferential direction to form the plurality of cantilevered arcuate arm portions into four arcuate arm portions that are cantilevered and have a circular arc shape, arranged in series along the circumferential direction, and the four bridge portions remain as a root portion;

wherein the circumferential length of the four arcuate arm portions is sufficiently large to provide adequate flexibility in a thickness direction with the four bridge portions as a support point, and the structure enables elastic deformation based on the elastic strength thereof in the thickness direction;

wherein a peripheral length and a wall thickness of the four arcuate arm portions are set to take account of the torque required when the drain plug is removed and the amount of flexing and deformation of the four arcuate arm portions required to engage/disengage the recess/projection engagement, so the operations do not lead to damage and repeated usage is possible;

wherein the bottom portion of the oil pan has an annular seat portion that includes four engaging recesses for engaging with the four arcuate arm portions, wherein the four engaging recesses each comprise a flat bottom surface parallel to an upper surface of the annular seat portion, and a first inclined surface and a second inclined surface having a different inclination from one another.

14. The internal combustion engine as claimed in claim 13, wherein, when the columnar stopper portion is rotated up to a rotation limit position at which the drain hole is closed off, both of the loosening-prevention meshing portions fit together in the recess/projection engagement.

15. The internal combustion engine as claimed in claim 14, wherein the drain plug is drawn into the drain hole as the drain plug rotates, as a result of engagement of a helical cam groove disposed on one of an inner circumferential surface of the drain hole and an outer circumferential surface of the columnar stopper portion, and a protrusion is disposed on the other of the inner circumferential surface of the drain hole and the outer circumferential surface of the columnar stopper portion.

16. The internal combustion engine as claimed in claim 15, wherein the oil pan in which the drain hole is disposed and the drain plug are both made of a resin.

17. The internal combustion engine as claimed in claim 13, wherein the four arcuate arm portions include engaging projections respectively disposed at a tip end portion on a rear surface of the four arcuate arm portions, and wherein the wall thickness of the four arcuate arm portions is greater at the tip end portion than at a base portion connected to the four bridge portions.

18. The internal combustion engine as claimed in claim 13, wherein the four arcuate arm portions include engaging projections respectively disposed at a tip end portion on a rear surface of the four arcuate arm portions, and wherein the engaging projections each comprise a flat top portion parallel to the rear surface, a first inclined surface extending from the flat top portion towards the root portion defined by the four bridge portions, and a second inclined surface disposed between the flat top portion and a tip end surface of the corresponding one of the four arcuate arm portions.

19. The internal combustion engine as claimed in claim 18, wherein the second inclined surface of the engaging projections has a greater incline relative to the flat top portion than the first inclined surface of the engaging projections.

* * * * *